US007245192B2

(12) United States Patent
Podell

(10) Patent No.: US 7,245,192 B2
(45) Date of Patent: Jul. 17, 2007

(54) COUPLER WITH EDGE AND BROADSIDE COUPLED SECTIONS

(75) Inventor: Allen F. Podell, Palo Alto, CA (US)

(73) Assignee: Werlatone, Inc., Brewster, NY (US)

( * ) Notice: Subject to any disclaimer, the term of this patent is extended or adjusted under 35 U.S.C. 154(b) by 0 days.

(21) Appl. No.: 11/075,608

(22) Filed: Mar. 8, 2005

(65) Prior Publication Data

US 2005/0146394 A1 Jul. 7, 2005

Related U.S. Application Data

(63) Continuation-in-part of application No. 10/731,174, filed on Dec. 8, 2003, now Pat. No. 6,972,639.

(51) Int. Cl.
*H01P 5/18* (2006.01)
*H01P 5/12* (2006.01)

(52) U.S. Cl. ..... 333/112; 333/116

(58) Field of Classification Search ..... 333/109, 333/112, 113, 116; 336/200
See application file for complete search history.

(56) References Cited

U.S. PATENT DOCUMENTS

| | | | | |
|---|---|---|---|---|
| 3,319,190 | A | 5/1967 | Shively | 333/115 |
| 3,345,585 | A | 10/1967 | Hildebrand | 333/116 |
| 3,371,284 | A | 2/1968 | Engelbrecht | 330/286 |
| 3,516,024 | A | 6/1970 | Lange | 333/116 |
| 3,534,299 | A | 10/1970 | Eberhardt | 333/24.2 |
| 3,678,433 | A | 7/1972 | Hallford | 333/203 |
| 3,904,991 | A | 9/1975 | Ishii et al. | 333/116 |
| 3,967,220 | A | 6/1976 | Tagashira et al. | 333/28 R |
| 3,999,150 | A | 12/1976 | Caragliano et al. | 333/116 |
| 4,158,184 | A | 6/1979 | Kenyon | 333/208 |
| 4,216,446 | A | 8/1980 | Iwer | 333/112 |
| 4,394,630 | A | 7/1983 | Kenyon et al. | 333/116 |
| 4,482,873 | A | 11/1984 | Nyhus | 333/116 |

(Continued)

FOREIGN PATENT DOCUMENTS

EP 1014472 A1 * 11/1999

OTHER PUBLICATIONS

An, Hongming et. al, *IA 50: 1 Bandwidth Cost-Effective Coupler with Sliced Coaxial Cable,* IEEE MTT-S Digest, pp. 789-792, Jun. 1996.

(Continued)

*Primary Examiner*—Dean Takaoka
(74) *Attorney, Agent, or Firm*—Kolisch Hartwell, PC

(57) ABSTRACT

Couplers are disclosed that include first and second mutually coupled conductors. The coupled conductors may be regular or irregular in configuration, and for example, may be linear, including rectilinear or with one or more curves, bends or turns, such as forming a ring, coil, spiral or other loop. One or more sections of a coupler may be on different levels and separated by a dielectric medium, such as air or a dielectric substrate. Coupled conductors may be facing each other on the same or spaced-apart dielectric surfaces, such as opposing surfaces of a common substrate, and each conductor may include one or more portions on each side or surface of a substrate. In some examples, a coupler may include plural coupled sections, with conductors in one section being only broadside coupled, and conductors in another section being edge-coupled.

13 Claims, 6 Drawing Sheets

U.S. PATENT DOCUMENTS

| | | | | |
|---|---|---|---|---|
| 4,777,458 | A | 10/1988 | Pardini | 333/112 |
| 4,800,345 | A | 1/1989 | Podell et al. | 333/111 |
| 4,937,541 | A | 6/1990 | Podell et al. | 333/116 |
| 4,999,593 | A | 3/1991 | Anderson | 333/112 |
| 5,075,646 | A | 12/1991 | Morse | 333/116 |
| 5,369,379 | A | 11/1994 | Fujiki | 333/116 |
| 5,557,245 | A | 9/1996 | Taketa et al. | 333/116 |
| 5,563,558 | A | 10/1996 | Mohwinkel et al. | 333/127 |
| 5,634,208 | A | 5/1997 | Nishikawa et al. | 455/327 |
| 5,689,217 | A | 11/1997 | Gu et al. | 333/116 |
| 5,742,210 | A | 4/1998 | Chaturvedi et al. | 333/116 |
| 5,781,071 | A | 7/1998 | Kusunoki | 330/269 |
| 5,793,272 | A | 8/1998 | Burghartz et al. | 336/200 |
| 5,841,328 | A | 11/1998 | Hayashi | 333/116 |
| 5,852,866 | A | 12/1998 | Kuettner et al. | 29/608 |
| 5,889,444 | A | 3/1999 | Johnson et al. | 333/127 |
| 5,926,076 | A | 7/1999 | Johnson et al. | 333/109 |
| 5,982,252 | A | 11/1999 | Werlau | 333/127 |
| 6,020,783 | A | 2/2000 | Coppola | 327/556 |
| 6,246,299 | B1 | 6/2001 | Werlau | 333/127 |
| 6,342,681 | B1 | 1/2002 | Goldberger et al. | 174/261 |
| 6,346,863 | B2 | 2/2002 | Sasaki et al. | 333/116 |
| 6,396,362 | B1 | 5/2002 | Mourant et al. | 333/25 |
| 6,407,647 | B1 | 6/2002 | Apel et al. | 333/125 |
| 6,407,648 | B1 | 6/2002 | Johnson | 333/127 |
| 6,483,397 | B2 | 11/2002 | Catoiu | 333/116 |
| 6,515,556 | B1 | 2/2003 | Kato et al. | 333/116 |
| 6,518,856 | B1 | 2/2003 | Casale et al. | 333/124 |
| 6,522,222 | B1 | 2/2003 | Pchelnikov et al. | 333/161 |
| 6,580,334 | B2 | 6/2003 | Simburger et al. | 333/24 R |
| 6,642,809 | B2 | 11/2003 | Shin et al. | 333/116 |
| 6,686,812 | B2 | 2/2004 | Gilbert et al. | 333/112 |
| 6,747,525 | B2 | 6/2004 | Iida et al. | 333/116 |
| 6,756,860 | B2 | 6/2004 | Shin | 333/116 |
| 6,765,455 | B1 | 7/2004 | De Lillo et al. | 333/116 |
| 6,771,141 | B2 | 8/2004 | Iida | 333/116 |
| 6,794,954 | B2 | 9/2004 | Gurvich et al. | 333/116 |
| 6,806,558 | B2 | 10/2004 | Apel | 257/663 |
| 6,806,789 | B2 | 10/2004 | Bawell et al. | 333/117 |
| 6,819,200 | B2 | 11/2004 | Zhao et al. | 333/25 |
| 6,822,532 | B2 | 11/2004 | Kane et al. | 333/116 |
| 6,927,664 | B2 * | 8/2005 | Nakatani et al. | 336/200 |

OTHER PUBLICATIONS

Walker, J.L.B., *Analysis and Design of Kemp-Type 3 dB Quadrature Couplers,* IEEE Transactions on Microwave Theory and Techniques, vol. 38, No. 1, pp. 88-90, Jan. 1990.

Bickford, Joel D. et. al, *Ultra-Broadband High-Directivity Directional Coupler Design,* IEEE MTT-S Digest, pp. 595-598, 1988.

Young, Leo, *The analytical equivalence of TEM-mode directional couplers and transmission-line stepped-impedance filters,* Proceedings IEEE, vol. 110, No. 2, pp. 275-281, Feb. 1963.

Levy, Ralph, *General Synthesis of Asymmetric Multi-Element Coupled-Transmission-Line Directional Couplers,* * IEEE Transactions on Microwave Theory and Techniques, vol. MTT-11, No. 4, pp. 226-237, Jul. 1963.

Monteath, G.D., *Coupled Transmission Lines as Symmetrical Directional Couplers,* Proc. IEE, vol. 102, Part B, No. 3, pp. 383-392, May 1955.

Oliver, Bernard M., *Directional Electromagnetic Couplers,* * Proc. IRE, vol. 42, No. 11, pp. 1686-1692, Nov. 1954.

Gerst, C.W., *11-7 Electrically Short 90° Couplers Utilizing Lumped Capacitors,* Syracuse University Research Corporation, pp. 58-62, year unknown.

Unofficial English translation of EP 1,014,472 obtained from Babelfish Internet translation site (http://babelfish.altavista.com) on Mar. 31, 2006, 2 pages.

* cited by examiner

COUPLER WITH EDGE AND BROADSIDE COUPLED SECTIONS

RELATED APPLICATION

This application is a continuation in part of U.S. patent application Ser. No. 10/731,174, filed on Dec. 8, 2003 now U.S. Pat. No. 6,972,639, which application is incorporated by reference for all purposes.

BACKGROUND

Two conductive lines are coupled when they are spaced apart, but spaced closely enough together for energy flowing in one to be induced in the other. The amount of energy flowing between the lines is related to the dielectric medium the conductors are in and the spacing between the lines. Even though electromagnetic fields surrounding the lines are theoretically infinite, lines are often referred to as being closely or tightly coupled, loosely coupled, or uncoupled, based on the relative amount of coupling.

Couplers are electromagnetic devices formed to take advantage of coupled lines, and may have four ports, one associated with each end of two coupled lines. A main line has an input connected directly or indirectly to an input port. The other end is connected to the direct port. The other secondary or auxiliary line extends between a coupled port and an isolated port. A coupler may be reversed, and any given port may function as any one of the four types of ports, depending on how the coupler is connected to external circuits.

Directional couplers are four-port networks that may be simultaneously impedance matched at all ports. Power may flow from an input port to a corresponding pair of output ports, and if the output ports are properly terminated, the ports of the input pair are isolated. A hybrid is generally assumed to divide its output power equally between the two outputs, whereas a directional coupler, as a more general term, may have unequal outputs. Often, the coupler has very weak coupling to the coupled output, which reduces the insertion loss from the input to the main output. One measure of the quality of a directional coupler is its directivity, which is the ratio of the desired coupled output to the isolated port output.

Adjacent parallel transmission lines couple both electrically and magnetically. The coupling is inherently proportional to frequency, and the directivity can be high if the magnetic and electric couplings are equal. Longer coupling regions increase the coupling between lines, until the vector sum of the incremental couplings no longer increases, and the coupling will decrease with increasing electrical length in a sinusoidal fashion. In many applications it is desired to have a constant coupling over a wide band. Symmetrical couplers exhibit inherently a 90-degree phase difference between the coupled output ports, whereas asymmetrical couplers have phase differences that approach zero-degrees or 180-degrees.

Unless ferrite or other high permeability materials are used, greater than octave bandwidths at higher frequencies are generally achieved through cascading couplers. In a uniform long coupler the coupling rolls off when the length exceeds one-quarter wavelength, and only an octave bandwidth is practical for +/−0.3 dB coupling ripple. If three equal length couplers are connected as one long coupler, with the two outer sections being equal in coupling and much weaker than the center coupling, a wideband design results. At low frequencies all three couplings add. At higher frequencies the three sections can combine to give reduced coupling at the center frequency, where each coupler is one-quarter wavelength. This design may be extended to many sections to obtain a very large bandwidth.

Two characteristics exist with the cascaded coupler approach. One is that the coupler becomes very long and lossy, since its combined length is more than one-quarter wavelength long at the lowest band edge. Further, the coupling of the center section gets very tight, especially for 3 dB multi-octave couplers. A cascaded coupler of X:1 bandwidth is about X quarter wavelengths long at the high end of its range. As an alternative, the use of lumped, but generally higher loss, elements has been proposed.

These couplers, other than lumped element versions, are designed using an analogy between stepped impedance couplers and transformers. As a result, the couplers are made in stepped sections that each have a length of one-fourth wavelength of a center design frequency, and may be several sections long.

BRIEF SUMMARY OF THE DISCLOSURE

Couplers are disclosed that include first and second mutually coupled conductors. The coupled conductors may be regular or irregular in configuration, and for example, may be linear, including rectilinear or with one or more curves, bends or turns, such as forming a ring, coil, spiral or other loop. One or more sections of a coupler may be on different levels and separated by a dielectric medium, such as air or a dielectric substrate. Coupled conductors may be facing each other on the same or spaced-apart dielectric surfaces, such as opposing surfaces of a common substrate, and each conductor may include one or more portions on each side or surface of a substrate. In some examples, a coupler may include plural coupled sections, with conductors in one section being only broadside coupled, and conductors in another section being edge-coupled.

BRIEF DESCRIPTION OF THE SEVERAL FIGURES

Figure 3:
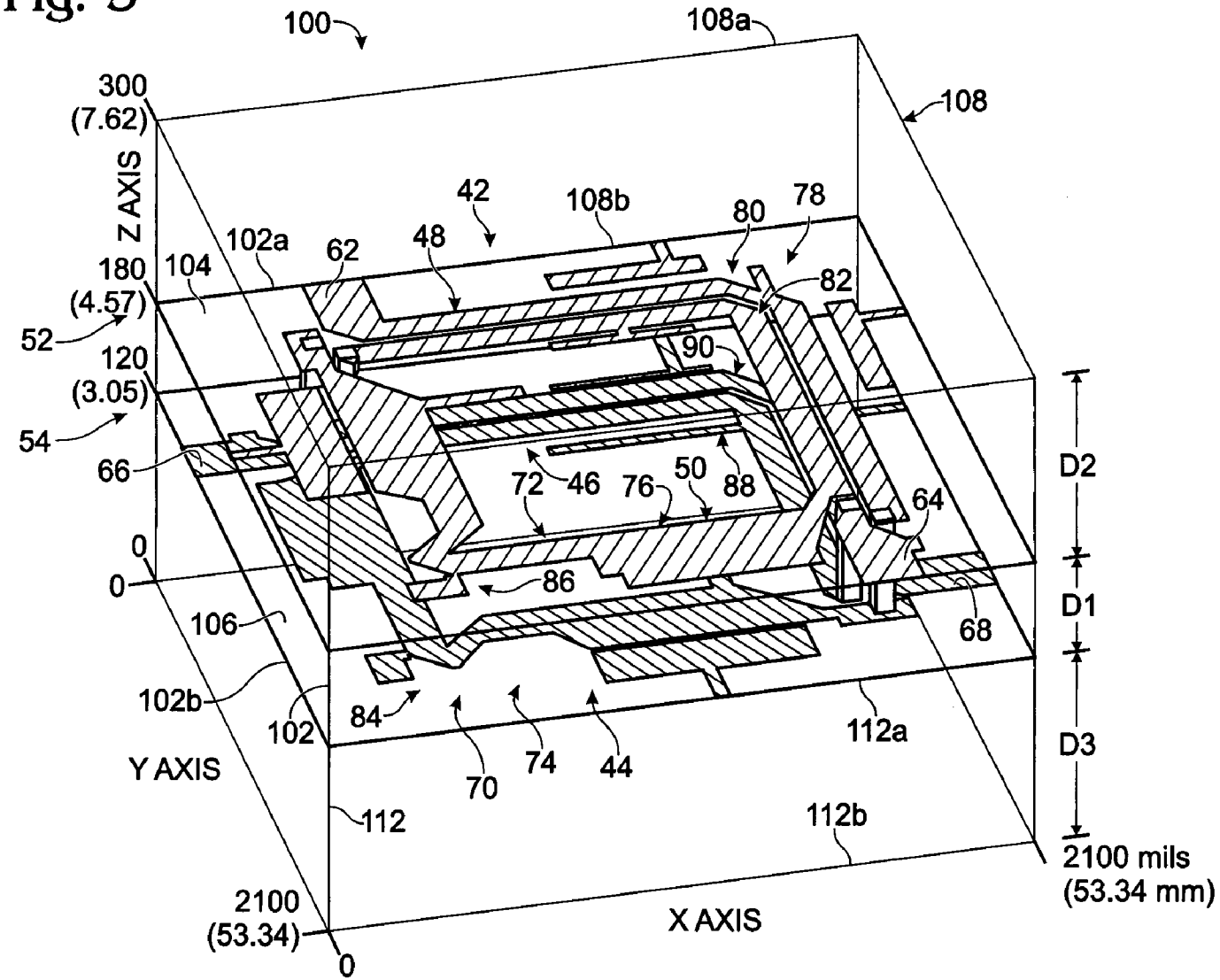
FIG. 3 is an isometric view of a third coupler.
Figure 5:
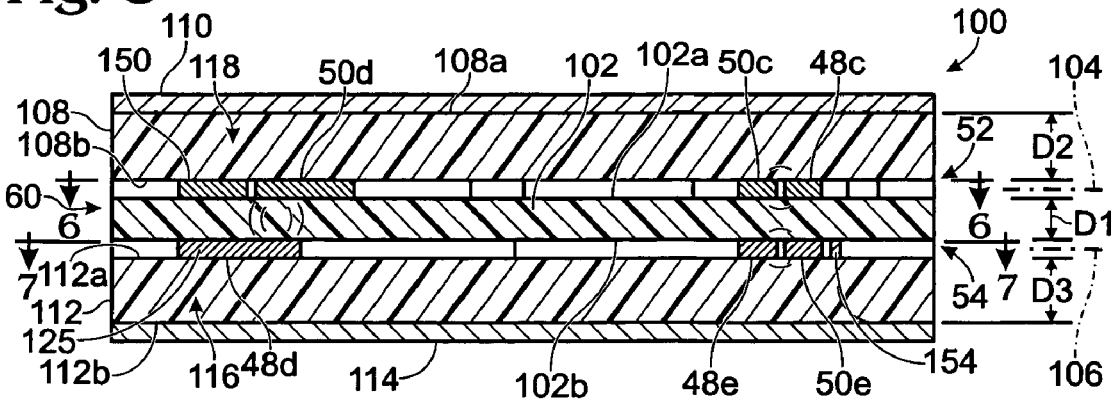
FIG. 5 is a cross section taken along line 5-5 in FIG. 4.
Figure 6:
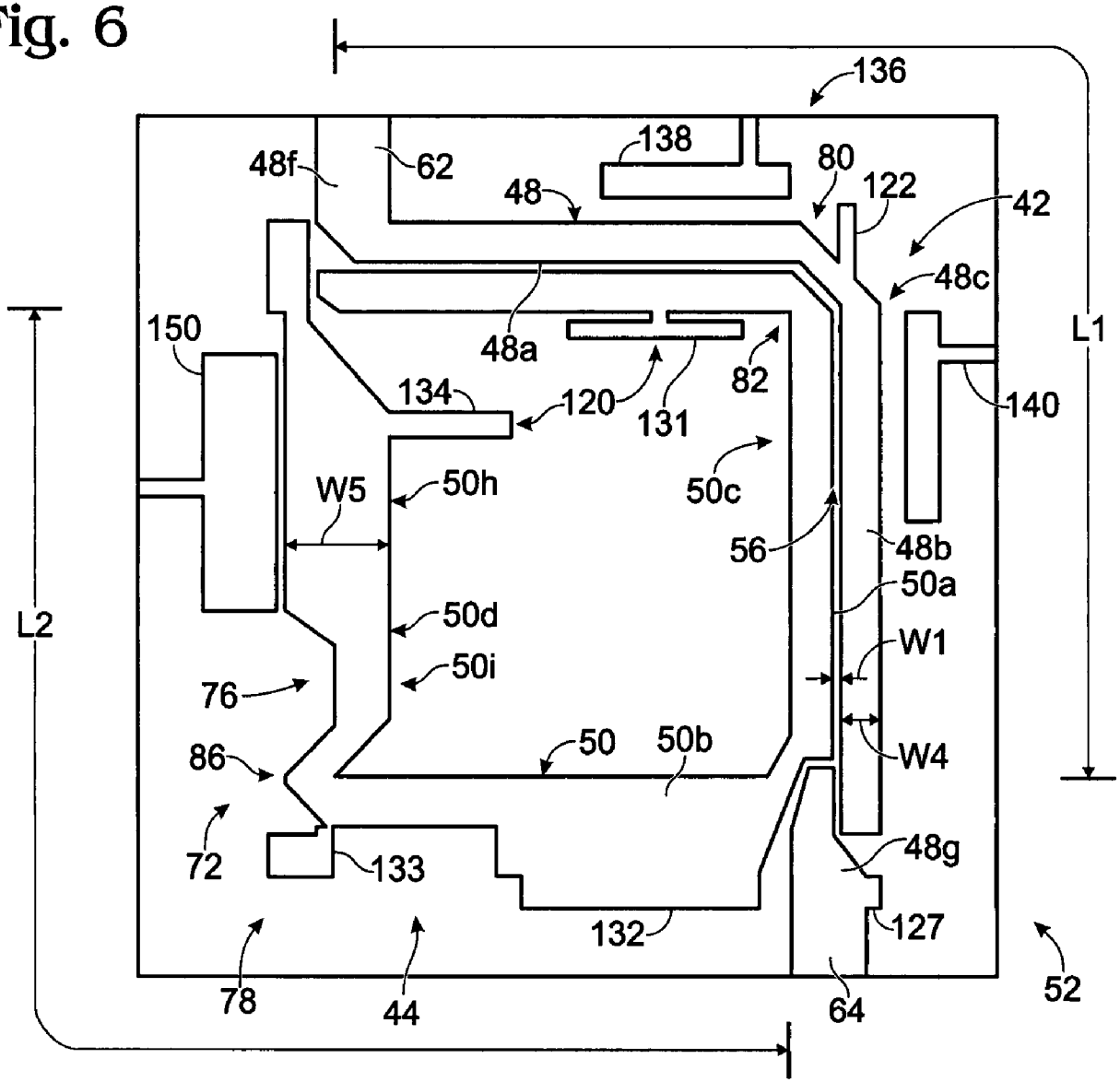

FIG. 6 a plan view of a first conductive layer of the coupler of FIG. 3 taken along line 6-6 of FIG. 5.

Figure 7:
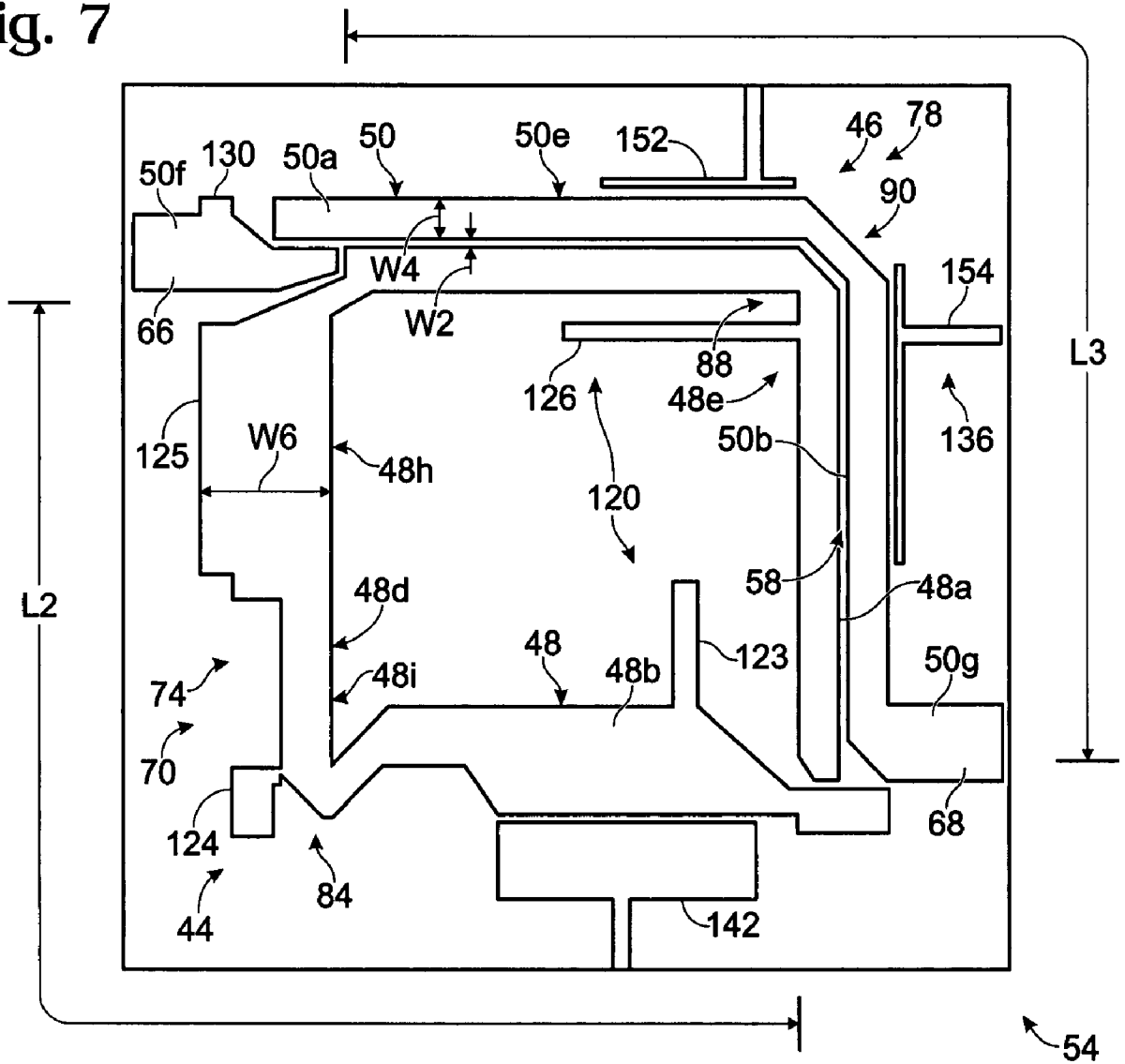

FIG. 7 is a plan view of a second conductive layer of the coupler of FIG. 3 taken along line 7-7 of FIG. 5.

Figure 8:
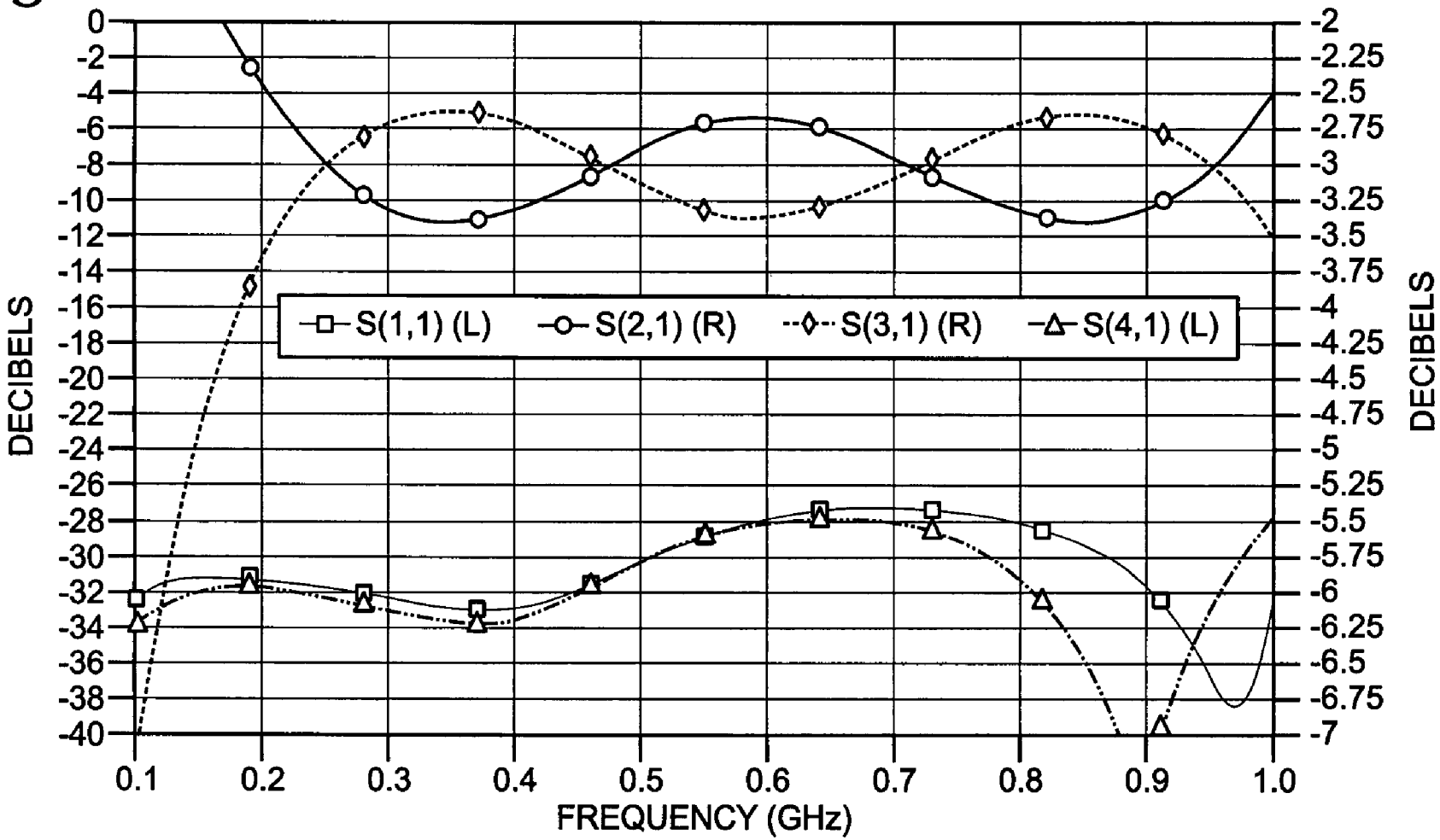

FIG. 8 is a plot of selected operating parameters simulated as a function of frequency for the coupler of FIG. 3.

DETAILED DESCRIPTION OF VARIOUS EMBODIMENTS

Two coupled lines may be analyzed based on odd and even modes of propagation. For a pair of identical lines, the even mode exists with equal voltages applied to the inputs of the lines, and for the odd mode, equal out-of-phase voltages. This model may be extended to non-identical lines, and to multiple coupled lines. For high directivity in a 50-ohm system, for example, the product of the characteristic impedances of the odd and even modes, e.g., $Z_{oe}*Z_{oo}$ is equal to $Z_o^2$, or 2500 ohms. $Z_o$, $Z_{oe}$, and $Z_{oo}$ are the characteristic impedances of the coupler, the even mode and the odd mode, respectively. Moreover, the more equal the velocities of propagation of the two modes are, the better the directivity of the coupler.

A dielectric above and below the coupled lines may reduce the even-mode impedance while it may have little effect on the odd mode. Air, having a dielectric constant of 1, may reduce the amount that the even-mode impedance is reduced compared to other dielectrics having a higher dielectric constant. However, fine conductors used to make a coupler may need to be supported.

Spirals or other loops may also increase the even-mode impedance for a couple of reasons. One reason is that the capacitance to ground may be shared among multiple conductor portions. Further, magnetic coupling between adjacent conductors raises their effective inductance. A loop line is also smaller than a straight line, and easier to support without impacting the even mode impedance very much.

Air also may be used as a dielectric. However, using air as a dielectric above and below the spirals while supporting the spirals on a material having a dielectric greater than 1 may produce a velocity disparity, because the odd mode propagates largely through the dielectric between the coupled lines, and is therefore slowed down compared to propagation in air, while the even mode propagates largely through the air.

The odd mode of propagation is as a balanced transmission line. In order to have the even and odd mode velocities equal, the even mode needs to be slowed down by an amount equal to the reduction in velocity introduced by any dielectric loading of the odd mode. This may be accomplished by making a somewhat lumped delay line of the even mode. Adding capacitance to ground at the center of the spiral section produces an L-C-L low pass filter. This may be accomplished by widening the conductors in the middle or intermediate portion of the spirals. The coupling between portions of the spiral modifies the low pass structure into a nearly all-pass "T" section. When the electrical length of the spiral is large enough, such as greater than one-eighth of a design center frequency, the spiral may not be considered to function as a lumped element. As a result, it may be nearly all-pass. The delay of the nearly all pass even mode and that of the balanced dielectrically loaded odd mode may be made approximately equal over a decade bandwidth.

As the design center frequency is reduced, it is possible to use more turns in the spiral to make it more lumped and all-pass, with better behavior at the highest frequency. Physical scaling down also may allow more turns to be used at high frequencies, but the dimensions of traces, vias, and the dielectric layers may become difficult to realize.

Figure 1:
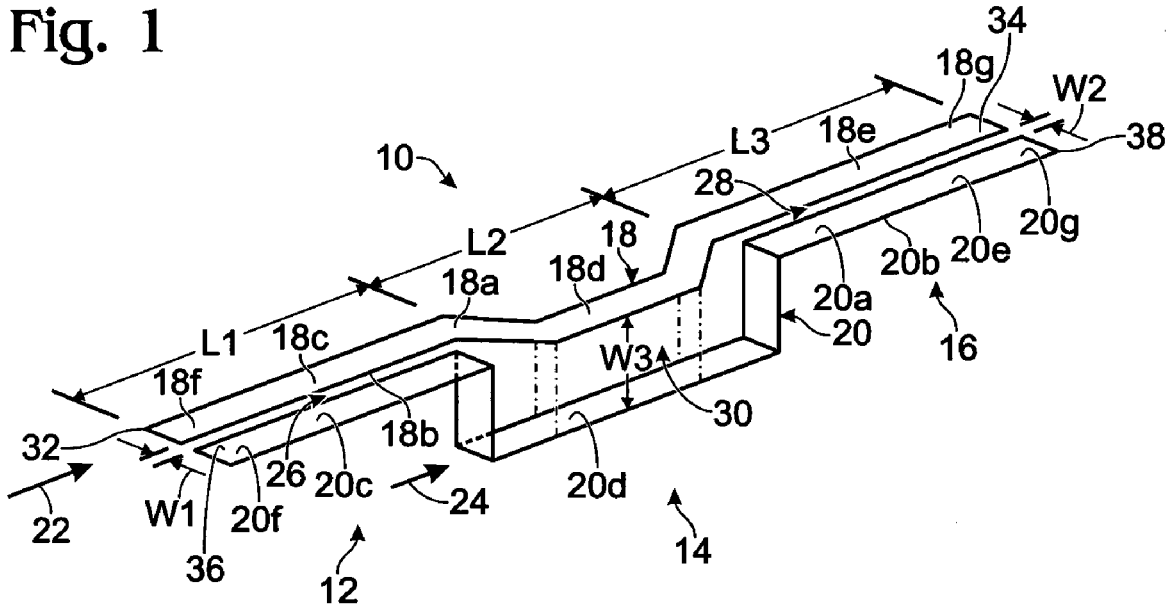
FIG. 1 is a simplified isometric illustration of a first coupler.

FIG. 1 depicts a three-section coupler 10, including a first, edge-coupled section 12, an intermediate second broadside-coupled section 14, and a third, edge-coupled section 16. The serially connected coupled sections are formed from first and second conductors 18 and 20. In this example, conductors 18 and 20 are strip conductors having broad faces, such as faces 18*a* and 20*a*, and narrow edges, such as edges 18*b* and 20*b*. Also in this example, conductor 18 extends along a single level or plane 22, and conductor 20 extends along plane 22 as well as along a second level or plane 24. These planes may correspond to dielectric surfaces, where appropriate for support of the conductors, such as surfaces of a dielectric substrate or substrates.

More specifically, conductors 18 and 20 further include respective first portions 18*c* and 20*c*, second portions 18*d* and 20*d*, and third portions 18*e* and 20*e*. First portions 18*c* and 20*c*, as well as third portions 18*e* and 20*e*, have adjacent edges 18*b* and 20*b* defining gaps 26 and 28, having respective widths W1 and W2, that are sufficiently narrow to provide edge coupling between the conductor portions. Second portions 18*d* and 20*d* are disposed in overlapping relation, with portion 18*d* directly over, or aligned normal to the faces of the conductors with portion 20*d* and spaced apart by a gap 30 having a width W3. Optionally, the faces may be only partially overlapping or not overlapping at all. In this configuration, a lower face 18*a* of conductor 18 faces an upper face 20*a* of conductor 20, producing broadside coupling between the conductor second portions.

Ends 18*f* and 18*g* of conductor 18, respectively, may be considered coupler ports 32 and 34, and ends 20*f* and 20*g* of conductor 20, respectively, may be considered coupler ports 36 and 38. Optionally, the conductor ends may be connected to ports remote from the illustrated coupler section, such as at the ends of additional associated coupled sections. The electrical lengths L1, L2 and L3 of the three coupled sections, dielectric constant(s) of dielectric media surrounding and between the conductors, the dimensions of the conductors, and the distances between the conductors may be dimensioned to produce a directional coupler of desired characteristics. In one example, the electrical lengths of two or more coupled sections may be equal, and the lengths of all three may be equal to a quarter wavelength of a frequency. Accordingly, other forms and configurations of a coupler having coupled sections may be used. For example, fewer or more coupled sections may be used, the conductors may extend along additional levels, or the levels may vary regularly or irregularly for each or all sections. For edge coupling, it may be sufficient that the conductors have facing edges, and for broadside coupling, it may be sufficient that the conductors have facing broad surfaces. Two faces may be considered facing, for instance, if a line can be drawn directly between them. Correspondingly, two faces may be considered overlapping if a line normal to the face of one conductor intersects a face of another. Surfaces may thus be facing each other without being overlapping or directly opposite each other.

Figure 2:
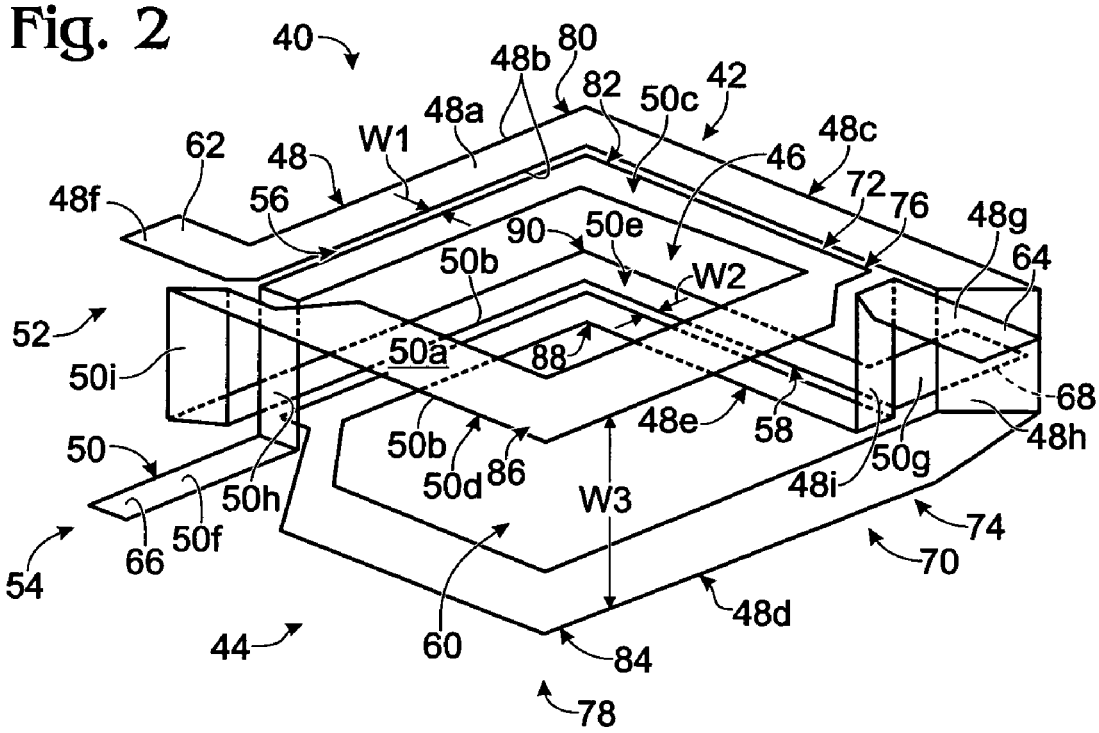
FIG. 2 is a simplified isometric illustration of a second coupler.

FIG. 2 depicts a coupler 40 that may be made with features similar to features of coupler 10. In such a configuration, coupler 40 may include coupled sections 42, 44 and 46 formed by at least a pair of conductors, such as conductors 48 and 50. As with conductors 18 and 20 described above, conductors 48 and 50 may be strip conductors, and have broad faces 48*a* and 50*a*, edges 48*b* and 50*b*, conductor portions 48*c* and 50*c* in coupled section 42, conductor portions 48*d* and 50*d* in coupled section 44, conductor portions 48*e* and 50*e* in coupled section 46, and ends 48*f*, 48*g*, 50*f* and 50*g*. In this example, different portions of both of conductors 48 and 50 are disposed on two levels 52 and 54, which levels may correspond to conductor planes and/or dielectric surfaces.

The conductors further include interconnects, such as vias, that interconnect conductor portions on different levels. More specifically, an interconnect 48*h* interconnects conductor portion 48*c* with conductor portion 48*d*, and an interconnect 48*i* interconnects conductor portion 48*e* with conductor end 48*g*. Similarly, an interconnect 50*h* interconnects conductor end 50*f* with conductor portion 50*c*, and an interconnect 50*i* interconnects conductor portion 50*d* with conductor portion 50*e*.

Conductors 48 and 50 may be coplanar in coupled sections 42 and 46 and separated by respective gaps 56 and 58, whereby the conductors have adjacent edges 48*b* and 50*b*, and are edge coupled. Conductors 48 and 50 may be in overlapping, vertically aligned relation in coupled section 44, separated by a gap 60 between facing conductor faces 48*a* and 50*a*. Accordingly, the conductors may be edge coupled in coupled sections 42 and 46, and broadside coupled in coupled section 44. Conductor ends 48*f*, 48*g*, 50*f* and 50*g* may extend to form coupler terminals or ports 62, 64, 66 and 68.

In this example, conductors 48 and 50, respectively, form loops 70 and 72, and in particular, spirals 74 and 76. Accordingly, there are bends or turns 78 in the conductors to form the loops or spirals. For example, coupled section 42 includes turns 80 and 82, coupled section 44 includes turns 84 and 86, and coupled section 46 includes turns 88 and 90. Additionally, there are turns not specifically identified between adjacent sections. Further, the conductor portions may be serially connected, as shown, with the conductor portions in coupled section 42 facing, aligned with and overlapping with the conductor portions in coupled section 46. In this configuration, conductor portion 48*c* is aligned with conductor portion 50*e*, and conductor portion 50*c* is aligned with conductor portion 48*e*. Accordingly, there may additionally be broadside coupling between these respective conductor portions. In some examples, the conductor sections may be offset relative to each other and still have facing faces and/or edges.

In this example, each coupled section forms a half-loop, with the spirals having one and one-half loops. In an embodiment in which the half-loops are of equal electrical length and the lengths of the three coupled sections are each a quarter of a design frequency wavelength, the coupler has a pass band centered at the design frequency, and the coupler includes three quarter-wavelength coupled sections.

FIGS. 3-7 illustrate a specific embodiment of a coupler 100 having features of couplers 10 and 40. Because of the similarity of features with coupler 40, like features are given the same reference numbers. Accordingly, the description of coupler 40 also applies generally to coupler 100. In this example, as particularly shown in FIG. 5, conductors 48 and 50 are disposed on opposing surfaces 102*a* and 102*b* of a dielectric substrate 102. The conductors on these dielectric surfaces define respective conductor planes 104 and 106. Planes 104 and 106 generally correspond to the planes of FIGS. 6 and 7, respectively.

A second dielectric substrate 108 is disposed on the conductors in plane 104. Substrate 108 includes opposing major surfaces 108*a* and 108*b*. In a general sense, then the conductors in plane 104 are therefore also disposed on substrate surface 108*b*. A conductive layer 110 that may function as a ground plane, is formed on substrate surface 108*a*. Similarly, a substrate 112, having major surfaces 112*a* and 112*b*, separates a second ground-plane conductive layer 114 disposed on surface 112*a* and the conductors in plane 106 that are also disposed on surface 112*b*. Conductive layers 110 and 114 may be ground planes, which, with conductors 48 and 50, form stripline transmission lines 116 and 118.

FIG. 3 includes dimensions in mils of an embodiment of coupler 100 along X, Y and Z axes, as shown. Approximate dimensions in millimeters are shown in parentheses. The three substrates may be made of an appropriate material, such as composite dielectric material, and may all have a corresponding dielectric constant, such as a dielectric constant equal to 3.38. Substrate 102 has a thickness D1 equal to 60 mils, or about 1.52 mm. Substrates 108 and 112 have equal thicknesses D2 and D3 of about 120 mils, or about 3.05 mm. The widths W4 of conductor portions in coupled segments 42 and 46 may all be equal and have a value of 100 mils, or 2.54 mm. Interconductor gaps W1 and W2 in coupled sections 42 and 46 may both be equal to 20 mils, or about 0.51 mm. Interconductor gap W3 is the same as substrate thickness D1. Optionally, dielectric materials with different and other dielectric constants and dimensions may be used.

Coupler 100 exhibits various forms of coupling. In coupled sections 42 and 46, the conductors are spaced relatively close together with edges 48*b* and 50*b* adjacent to each other, producing edge coupling. However, the conductors are reversed in section 46 compared to section 42, and these sections overlap, producing broadside coupling between the two sections. In particular, conductor section 48*c* is directly over (overlapping and aligned with) conductor section 50*e* and conductor section 50*c* is directly over (overlapping and aligned with) conductor section 48*e*, resulting in broadside coupling between the different conductors in the different conductor sections.

Figure 4:
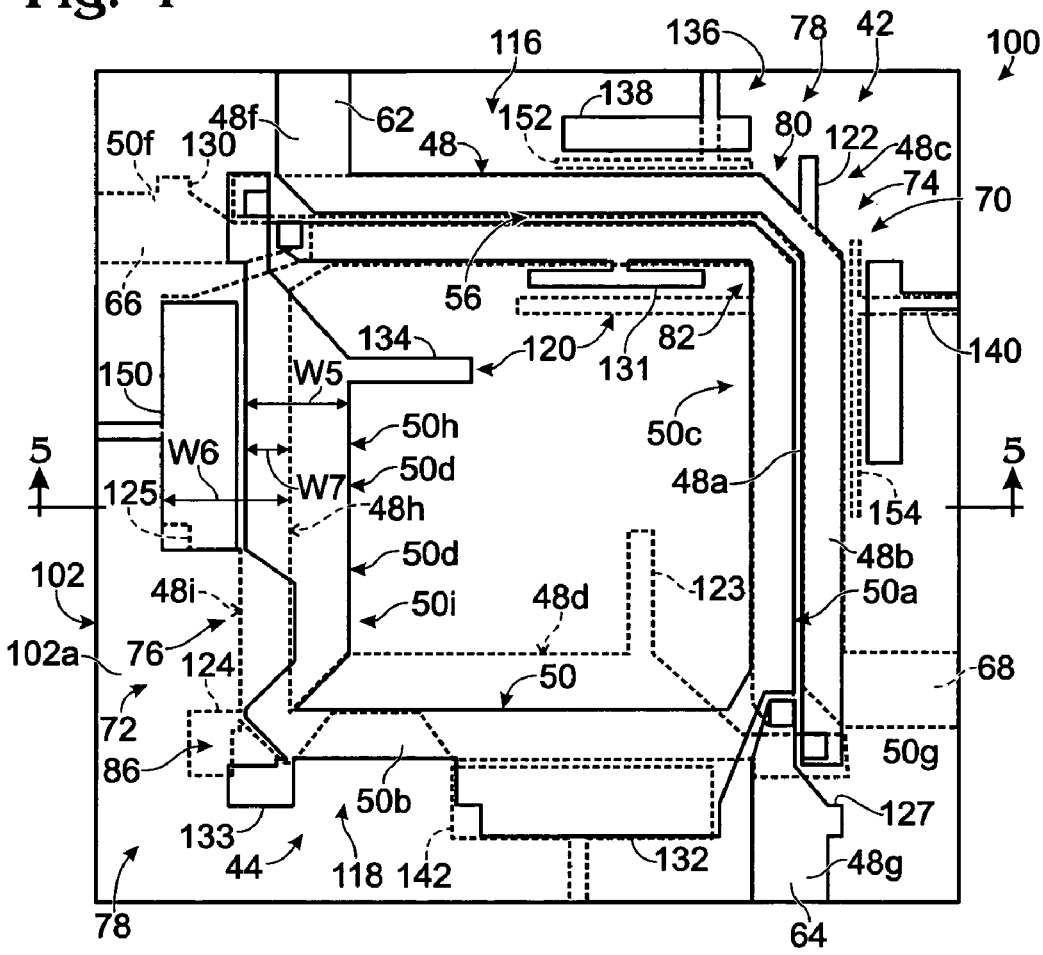
FIG. 4 is a plan view of the conductors of the coupler of FIG. 3.

In coupled section 44, the faces 48*a* and 50*a* face each other, and at least in part overlap each other, as viewed normal to the faces of the conductors, such as shown in FIG. 4, producing broadside coupling. Since the conductors are not side-by-side in section 44, there is no substantial edge coupling. As seen particularly in FIG. 4, coupled section 44 includes portions 44*a* and 44*b* in which portions of conductors 48 and 50 do overlap and portions that do not overlap. For example, a portion 50*h* of conductor 50 has a width W5. Opposite portion 50*h* is a portion 48*h* having a width W6. These conductors directly overlap over a width W7 that is less than widths W5 and W6. Broadside coupling is stronger in the regions where the conductors do overlap, and weakens with increased distance to the side of direct alignment. As discussed above, the wider conductor portions also produce increased coupling to ground.

Additionally, there is a further portion, such as portion 50*i* of conductor portion 50*d* that faces but is not overlapping with a corresponding portion 48*i* of conductor portion 48*d*. As mentioned, conductor portions 48*i* and 50*i* have reduced broadside coupling compared to the portions of conductor portions 48*h* and 50*h* that do overlap.

Other forms of coupling may also be provided in coupler 100. For example, there may be tabs 120 that laterally extend from and are part of conductors 48 and 50. Tabs 120 may variously provide coupling to the same conductor, to the other conductor, and/or to a ground plane. These include tabs 122, 123, 124, 125, 126 and 127 on conductor 48, and tabs 130, 131, 132, 133 and 134 on conductor 50. Coupler 100 additionally may include conductor pads 136 that are structurally spaced from or separate from either of the conductors, but which may edge and/or broadside couple to one or both of the conductors, to the ground plane, and/or to another pad. Examples of pads include pads 138, 140 and 142 disposed adjacent to and coupled to conductor 48, and pads 150, 152 and 154 disposed adjacent to and coupled to conductor 50. Pad 138 also couples with pad 152; pad 140 couples with pad 154; pad 142 couples with tab 132; pad 150 couples with tab 125. Additionally, tab 126 couples with tab 131. These various modes of coupling generally equalize the speed of and balance the odd and even modes of signal propagation.

Various scattering parameters over a frequency range of 0.1 GHz to 1.0 GHz are illustrated in FIG. 8 for an embodiment of coupler 100. There are two scales for the vertical axis: a scale on the left that extends from 0 decibels (dB) at the top to −40 dB at the bottom, and a scale on the right that varies from −2 dB on the top to −7 dB on the bottom. A curve 160 represents the transmission coefficient S(2,1), the gain on the direct port, and a curve 162 represents the transmission coefficient S(3,1), the gain on the coupled port. The right scale applies to both of these curves. It is seen that the curves have a ripple of about +/−0.5 dB about an average gain of about −3 dB. A curve 164 represents the transmission coefficient S(4,1), which curve indicates the isolation between the input and isolated ports. Finally, a curve 166 represents reflection coefficient S(1,1), and indicates the input return loss. Both the isolation and return loss are seen to be less than −27 dB over the entire frequency range.

While embodiments of couplers have been particularly shown and described, many variations may be made therein. Other coupler sections may also be used in couplers 10, 40 and 100, such as conventional rectilinear or curved tightly and loosely coupled sections, which sections may have an effective electrical length of an integral multiple of about one fourth of the wavelength of a design frequency. Other configurations, levels, dimensions, turns and other variations may be used in a particular application, and may be in the form of symmetrical or asymmetrical couplers, and/or hybrid or directional couplers.

Accordingly, this disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of features, combinations or elements not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed.

Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

INDUSTRIAL APPLICABILITY

Radio frequency couplers, coupler elements and components described in the present disclosure are applicable to telecommunications, computers, signal processing and other industries which couplers are utilized.

What is claimed is:

1. A coupler comprising:

at least first and second strip conductors configured as at least three coupled sections, with two coupled sections being configured as a substantially closed loop when viewed normal to the loop, the first and second conductors being substantially only broadside coupled in a first one of the coupled sections, being edge coupled along a given length in a second one of the coupled sections, and being edge coupled along the given length in a third one of the coupled sections, with the first coupled section being electrically disposed between the second and third coupled sections, and in which at least the first conductor in the second edge coupled section is also continuously broadside coupled along the given length to the second conductor in the third edge coupled section.

2. coupler according to claim 1, in which the second and third coupled sections have substantially equal electrical lengths.

3. A coupler according to claim 2, in which the second and third coupled sections each have an electrical length substantially equal to a quarter wavelength of a design frequency.

4. A coupler according to claim 1, in which the first and second conductors are wider in the first coupled section than in the second coupled section.

5. A coupler according to claim 1, in which the first and second conductors are in non-overlapping relation over a portion of the first coupled section.

6. A coupler according to claim 1, in which the first and second conductors have different widths for at least a portion of the first coupled section.

7. A coupler according to claim 1, in which the first and second conductors in the first coupled section are disposed in at least partially overlapping relation on spaced-apart dielectric surfaces, and in the second coupled section are disposed on a common dielectric surface.

8. A coupler comprising:

first and second spaced-apart planar dielectric surfaces;

a first conductor having serially connected first, second and third portions, the first portion of the first conductor being disposed on the first surface, the second portion of the first conductor being disposed on the first surface and directly connected to the first portion of the first conductor, and the third portion of the first conductor being disposed on the second surface and directly connected to the second portion of the first conductor; and a second conductor having serially connected first, second and third portions, the first portion of the second conductor having a given length and being disposed on the first surface and being configured to edge couple continuously along the given length to the first portion of the first conductor; the second portion of the second conductor being disposed on the second surface, being directly connected to the first portion of the second conductor, and being configured to only broadside couple to the second portion of the first conductor; and the third portion of the second conductor having the given length and being disposed on the second surface, being directly connected to the second portion of the second conductor, and being configured to edge couple to the third portion of the first conductors;

wherein the first portion of the first conductor is continuously broadside coupled along the given length to the third portion of the second conductor, and the first portion of the second conductor is broadside coupled continuously along the given length to the third portion of the first conductor.

9. A coupler according to claim 8, in which the first and third portions of the first and second conductors are of substantially equal electrical length.

10. A coupler according to claim 8, in which the first portion of the first conductor is spaced closer to the first portion of the second conductor than to the third portion of the second conductor.

11. A coupler according to claim 8, in which the first and second conductors each are configured as a substantially closed loop when viewed normal to the loop.

12. A coupler according to claim 11, in which the first and second conductors each form spiral.

13. A coupler according to claim 8, further comprising respective ports directly connected to the first and third portions of the first and second conductors.

* * * * *